United States Patent [19]

Parkyns et al.

[11] 4,040,322

[45] Aug. 9, 1977

[54] BOWS FOR MUSICAL INSTRUMENTS

[76] Inventors: Raymond Parkyns; Terence H. Hubble, both of 39 Craddocks Avenue, Ashtead, Surrey, England

[21] Appl. No.: 634,092

[22] Filed: Nov. 21, 1975

[30] Foreign Application Priority Data

Nov. 29, 1974 United Kingdom ..... 51856/74

[51] Int. Cl.[2] ..... G10D 1/02; G10D 3/00

[52] U.S. Cl. ..... 84/282; 84/297 S

[58] Field of Search ..... 84/282, 297 S

[56] References Cited

U.S. PATENT DOCUMENTS

| | | | |
|---|---|---|---|
| 564,448 | 7/1896 | Nelson | 84/282 |
| 2,263,793 | 11/1941 | Woerner | 84/282 |
| 2,592,715 | 4/1952 | Lesinsky | 84/282 |
| 3,122,960 | 3/1964 | Stuhlen | 84/282 |
| 3,143,913 | 8/1964 | Bried | 84/282 |

FOREIGN PATENT DOCUMENTS

| | | | |
|---|---|---|---|
| 56,490 | 7/1952 | France | 84/282 |
| 78,389 | 12/1894 | Germany | 84/282 |

*Primary Examiner*—Stephen J. Tomsky
*Attorney, Agent, or Firm*—Sughrue, Rothwell, Mion, Zinn and Macpeak

[57] ABSTRACT

A self-contained unit for the re-stringing of a bow for a musical instrument as a replacement for the traditional horse hair comprises a hank of reorientated monofilaments each containing at least a substantial proportion of polyvinyl chloride and having a diameter in the range of 0.15 to 0.40 mm. The adjacent free ends of the monofilaments are bonded together to form an enlargement at each end of the hank and these are preferably trapped mechanically in recesses at the ends of the bow although they can be glued in position in the traditional manner if required. When the unit is fitted mechanically the frame of the bow has at one end a recess with a restricted mouth fitted with a spring-loaded member for jamming the mouth under the spring force, but capable of yielding inwardly to permit the introduction of an enlargement at the end of the unit, and at the other end it has an adjustable frog formed with a recess provided with a longitudinally slidable cover.

6 Claims, 6 Drawing Figures

BOWS FOR MUSICAL INSTRUMENTS

Bows for violins and other similar stringed musical instruments are traditionally strung with horse hair which has the necessary surface roughness for holding the rosin which is used in order to obtain the desired frictional effecct on the strings of the instrument. The stringing operation is a slow, skilled one involving the individual selection and combing of the required number of hairs (e.g. 130 to 180), assembling these to form a hank and then binding the ends of the hank, prior to glueing these ends into recesses in the respective ends of the bow. Quite apart from the labour involved, horse hair has risen enormously in cost in recent years. Despite this, no satisfactory substitute has been found, whether natural or artificial.

The present invention is based on the discovery that monofilaments of polyvinyl chloride or of a mixture or blend containing a least a substantial proportion of polyvinyl chloride are slightly porous and thus have sufficient surface roughness for holding rosin in place. This property is made use of in accordance with the present invention to provide a self-contained unit for the re-stringing of a bow which comprises a hank of reorientated monofilaments each containing at least a substantial proportion of polyvinyl chloride and having a diameter in the range of 0.15 to 0.40 m.m., the adjacent free ends of the monofilaments being bonded together to form an enlargement at each end of the hank. The use of such a unit greatly simplifies the re-stringing of a bow since it is possible merely to trap the enlargements at the ends of the hank in recesses at the ends of the bow without the need for any of the time-consuming steps which were necessary previously when using horse hair. It is found that the monofilaments retain rosin in much the same way as horse hair and, when the bow is used on a stringed instrument, the result is as good as that produced by anything other than the very finest quality of horse hair. The reorientation of the filaments, which is carried out by stretching in the usual way, is necessary to give the filaments the tensile strength necessary for use in a bow.

The bonding together of the adjacent free ends of the monofilaments is preferably achieved by means of a welding operation which can be carried out at a relatively low temperature (e.g. 200° C) and which simultaneously produces the enlargements at the ends of the hank. Alternatively, the bonding can be carried out by means of a quick-setting adhesive. In either case it is preferable to clamp the ends first so that they are held in alignment during the bonding operation, whether by welding or by adhesive. In addition, the monofilaments are preferably held straight by insertion in a sheath of plastics material which is removed before the unit is fitted to a bow.

As mentioned above, a self-contained unit in accordance with the invention may be fitted to the frame of a bow merely by trapping the enlargements at the ends of the hanks mechanically in recesses at the ends of the bow frame. On the other hand, if required, the unit may be fitted to a conventional bow in the usual way. Most advantage is obtained, however, when fitted mechanically and to facilitate this operation, the frame of the bow preferably has at one end a recess with a restricted mouth fitted with a spring-loaded member for jamming the mouth under the spring force, but capable of yielding inwardly to permit the introduction of an enlargement at the end of the unit. At the other end the frame then has an adjustable frog formed with a recess provided with a longitudinally sliding cover which serves to trap the enlargement at the other end of the unit. The slidable cover may have a nose portion of reduced thickness which may be clamped against the body of the frog by a ferrule which encircles the end portion of the frog and which may be D-shaped with its flat side bearing against the nose portion of the frog and against the monofilaments of the unit at the point where they emerge from the recess so as to flatten them in the usual manner.

Quite apart from the cheapness of the stringing unit and the ease of re-stringing, the bow frame itself may be simplified and manufactured from synthetic materials and the construction of a complete bow in accordance with the invention will now be described in more detail, by way of example, with reference to the accompanying drawings, in which:-

Figure 1:
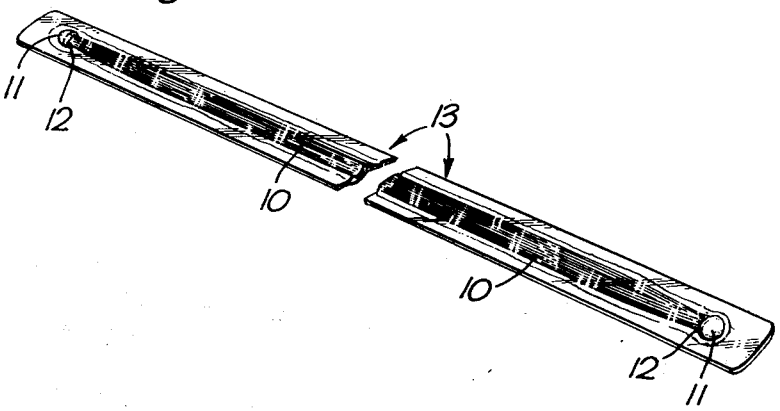
FIG. 1 shows a hank of monofilaments ready for fitting to a bow frame.
Figure 5:
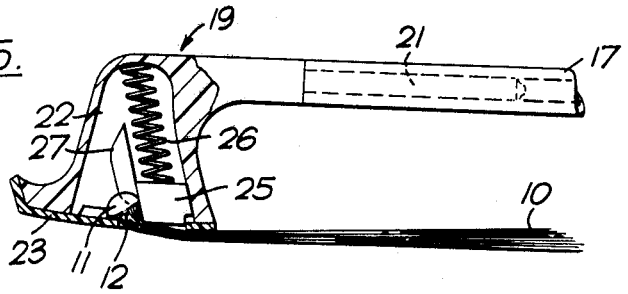
FIG. 5 is a view similar to FIG. 3, but showing the end of a hank firmly anchored in position.

The hank of monofilaments shown in FIG. 1 is indicated generally as 10 and in a typical example comprises 140 monofilaments each having a diameter in the range of 0.16 to 0.25 m.m. Generally speaking, the monofilaments will be of normal, commercial polyvinyl chloride, but as mentioned above, a mixture or blend is also possible provided it contains a substantial proportion of polyvinyl chloride which is necessary to give adequate surface porosity. The monofilaments are bonded together at each end of the hank to form a small enlargement 11 which is produced by welding together the ends of the monofilaments. In producing the hank, the required number of monofilaments are laid out side by side, clamped at one end at 12, combed and then clamped at the other end at 12, after which any irregularities at the ends are trimmed off. The welding is then carried out by gentle heating of the ends of the monofilaments in a hot air heater and then pressing the softened end of the hank into a cup-shaped mould to produce the rounded configuration shown in the drawing. This is carried out so that the enlargement 11 at one end is offset slightly in a lateral direction in the position it will eventually take up when fitted in a bow as shown in FIG. 5. A mark is then applied to the hank to make sure that it is fitted in the correct angular position to suit the offset enlargement. For purposes of storage and sale, the hank is then placed in a transparent sheath 13.

Figure 2:
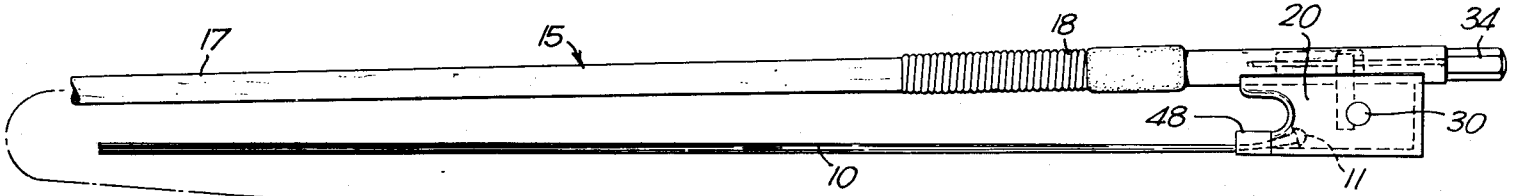
FIG. 2 shows the bow as a whole with its two halves displaced in relation to one another for ease of illustration.

FIG. 2 shows a complete bow, indicated as 15, with the hank 10 held in position mechanically at the two ends of the bow frame. As mentioned above, the use of a bow including a hank of monofilaments in accordance with the invention gives a result as good as that produced by anything other than the very finest quality horse hair. Since the very best quality results are unobtainable, there is no advantage in using traditional materials for the bow frame and, as illustrated, this also is appreciably simplified. Thus the stick 17 of the bow is formed as a tube of glassfibre-reinforced plastics material, being fitted with a grip 18 in the usual way. The fitting at the left hand end of the stick seen in FIG. 2 is shown as 19 and that at the right end, which is similar to the normal adjustable frog, as 20. Details of these fittings are seen more clearly in the enlarged sectional views of FIGS. 3 and 4 respectively.

Figure 3:
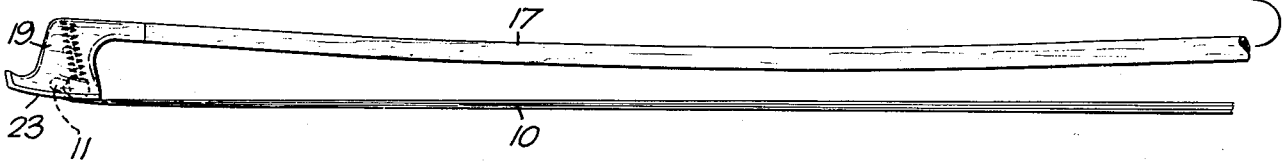
FIG. 3 is a cross-sectional view to an enlarged scale showing the left hand end of the bow seen in FIG. 2.
Figure 3:
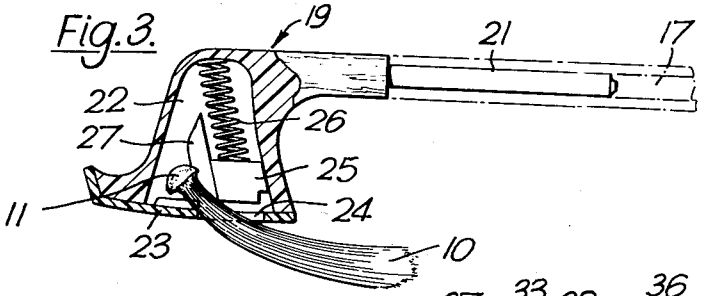

The fitting 19 seen in FIG. 3 is in the form of a moulding of plastics material with an insert constituted by a metal rod 21 which projects into the hollow interior of the stick 17 where it is glued in position. The moulding has a hollow interior 22, the open end of which is closed by a cover 23 formed with a mouth 24 in the form of a slot extending across the width of the fitting so as to spread the monofilaments in a transverse direction. The hollow interior 22 includes a slidable member 25 which is loaded by a compression spring 26 and the sliding movement of which is guided by projections on the opposite sides of the hollow interior, one of which is seen at 27. As a result of this construction, the member 25 is able to yield inwardly to the position shown in FIG. 3, against the force of the spring 26 so as to allow the insertion of the end of a hank 10 with its enlargement 11. When the member 25 is released it moves downwardly to the position shown in FIG. 5 in which it jams the slot 24, thus preventing the enlargement 11 being withdrawn and anchoring the end of the hank 10 firmly in position.

Figure 4:
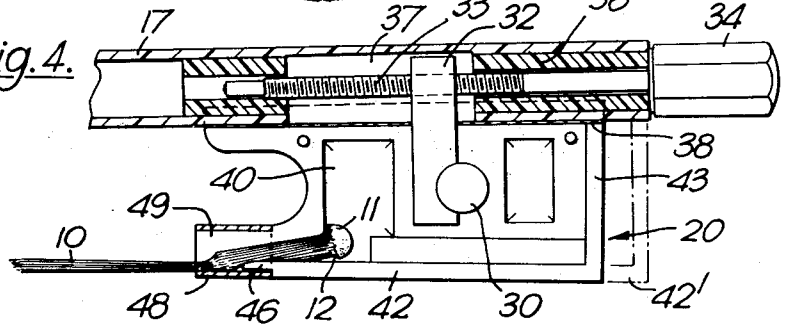
FIG. 4 is a cross-sectional view to a similar enlarged scale of the right hand end of the bow seen in FIG. 2.

The fitting 20 is also formed as a plastics moulding in two separate halves which are bonded together and positively located in relation to one another by a transverse peg 30. The peg 30 also locates a metal member 32 which projects upwardly as seen in FIG. 4 into the interior of the stick 17 where it is formed with a threaded opening co-operating with an adjusting screw 33. The screw 33 has a hexagonal head 34 by means of which it can be turned manually for adjustment purposes and is located by a moulding 36 fitted into the hollow interior of the stick 17 and formed with a recess 37 for the reception of the upper end of the member 32. Consequently, rotation of the head 34 causes adjustment of the fitting 20 as a whole along the length of the stick 17, metal plate 38 being interposed between the fitting 20 and the surface of the stick so as to facilitate the sliding movement. In other words, fitting 20 is adjustable in much the same manner as the normal frog for applying tension to the hank of monofilaments.

Fitting 20 is formed with a recess 40 for the reception of the right hand end of the hank 10 and its enlargement 11. The recess opens downwardly as seen in FIg. 4 and is provided with a cover 42 having an extension 43 which fits against the right hand side of the moulding as seen in FIG. 4, when in the closed position. The construction of this cover and of the adjusting arrangement already described can be seen more clearly in the exploded perspective view of FIG. 6. As best seen from this Figure, the inner side of the cover 42 is formed with a wedge-shaped ridge 44 which fits between the two halves of the moulding constituting the fitting 20 and guides the cover in its sliding movement between the closed position shown in full lines in FIG. 4 and an open position shown in dotted lines as 42'. In this open position the end of the hank can be introduced into the recess 40 and when the cover 42 is then moved back to its closed position, the enlargement 11 is trapped as illustrated.

Figure 6:
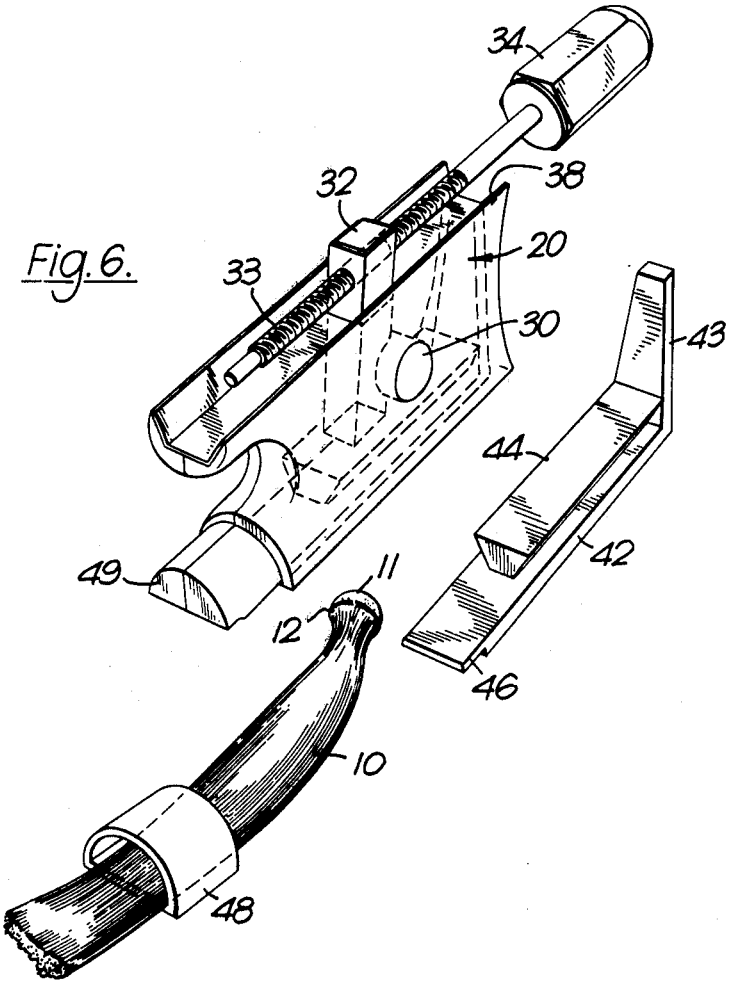
FIG. 6 is an exploded perspective view of the components shown in FIG. 4.

In order to assist in gripping the monofilaments and also to spread them transversely, the cover 42 is formed with a nose portion 46 of reduced thickness, over which fits a D-shaped ferrule 48 best seen in FIG. 6. As seen in this Figure, the ferrule is fitted over the end of the hank 10 before this is inserted in the recess 40. When the enlargement 11 has been trapped in the recess as just described, the ferrule 48 is slid to the right so that its straight side engages the nose portion 46, as seen in FIG. 4, and its rounded side engages a correspondingly shaped part 49 on the two halves of the moulding constituting the fitting 20. The ferrule is a tight fit in this position and completes the fixing of the end of the hank. When the ferrule is in position, the cover 42 cannot be slid to the right to release the end of the hank and the gripping action assists in holding the hank in position and also spreads the monofilaments as described above.

The operation just described is carried out with the fitting 20 moved towards the left hand end of its range of adjustment so that when the hank 10 is finally fitted in position it is quite slack. Once the fitting is complete, the adjusting screw 33 is turned so as to move the fitting 20 to the right and thus to apply the desired amount of tension to the monofilaments constituting the hank 10, after which, the bow is ready for use.

Although particularly suitable for use with a violin, a bow in accordance with the invention may be used with any other similar stringed instrument such as a cello, viola or double bass.

As already described, the stick 17 is made from glass-fibre-reinforced plastics material and although the materials used for the other components are by no means critical, specific materials are found to be particularly suitable. Thus the fitting 19 together with the cover 23 and the member 25 may be formed from glass-filled styrene and the inserted rod 21 of aluminium. The grip 18 may be of polyvinyl chloride while the fitting 20 may again be of glass-filled styrene. The cover 42 may be of acrylonitrile - butadiene-styrene and finally the plate 38 and the ferrule 48 are conveniently of brass.

We claim:

1. A self-contained unit for the re-stringing of a bow for a musical instrument, said unit comprising a hank of reorientated monofilaments each said monofilament containing at least a substantial proportion of polyvinyl chloride and having a diameter in the range of 0.15 to 0.40 m.m, the adjacent free ends of said monofilaments being bonded together and an enlargement at each end of said hank, said enlargement being formed by said bonded monofilaments.

2. A unit according to claim 1 in which the adjacent free ends of said monofilaments are welded together.

3. A bow for a musical instrument comprising a frame formed at each end with a recess, a unit comprising a hank of reorientated monofilaments each said monofilament containing at least a substantial proportion of polyvinyl chloride and having a diameter in the range of 0.15 to 0.40 m.m, the adjacent free ends of said monofilaments being bonded together and an enlargement at each end of said hank, said enlargement being formed by said bonded monofilaments, and mechanical means trapping said enlargements in said recesses.

4. In combination with a unit comprising a hank of reorientated monofilaments, each said monofilament containing at least a substantial proportion of polyvinyl chloride and having a diameter in the range of 0.15 to 0.40 m.m, the adjacent free ends of said monofilaments being bonded together and an enlargement at each end of said hank, said enlargement being formed by said bonded monofilaments, an elongated bow frame, said frame having first and second ends and having at said first end a hollow fitting defining a recess which faces away from and at right angles to the longitudinal axis of said elongated bow frame, a cover closing off the end of said hollow fitting and defining a restricted mouth, a member mounted within said hollow fitting for movement in the plane of the recess at right angles to the longitudinal axis of the elongated bow frame and for movement towards said restricted mouth for jamming said mouth, a compression spring interposed between said member and an interior wall of said hollow fitting within said recess for biasing said member towards said mouth, whereby said member is capable of yielding inwardly to permit the introduction of said enlargement at one end of said unit, said elongated bow frame having at its second end a frog fixed thereto and forming a second recess facing away from said elongated bow frame, a longitudinally slidable cover mounted to said elongated bow frame adjacent said frog and including a portion moving parallel to the axis of said elongated bow frame to close said recess and to form a transverse slot and means for adjusting said longitudinally slidable cover longitudinally of said frame to variably close off said slot and to lock a second enlargement at the other end of said unit between said frog and said longitudinally slidable cover to lock the same within said recess.

5. A bow frame according to claim 4, wherein said frog further comprises a tubular ferrule through which the enlargement at one end of said unit projects and said cover comprises a nose portion of reduced thickness which is received within said ferrule to clamp the end of said unit against said frog.

6. A bow frame according to claim 5, wherein said ferrule is D-shaped including a flat side against which the nose portion of said cover bears and against which said monofilaments of said unit emerge from said recess.

* * * * *